United States Patent [19]

Ryder et al.

[11] 4,075,714

[45] Feb. 28, 1978

[54] HELMET CHARACTERIZED BY NEGATIVE LIFT

[75] Inventors: James H. Ryder, Sierra Madre; David C. Brown, Pasadena; Johannes A. Van Haastert, Temple City, all of Calif.

[73] Assignee: Sierra Engineering Co., Sierra Madre, Calif.

[21] Appl. No.: 742,007

[22] Filed: Nov. 15, 1976

[51] Int. Cl.[2] ..... A42B 3/00

[52] U.S. Cl. ..... 2/6; 2/421; 2/425

[58] Field of Search ..... 2/6, 421, 425, 424, 2/9

[56] References Cited

U.S. PATENT DOCUMENTS

| | | | |
|---|---|---|---|
| 3,081,460 | 3/1963 | Miller | 2/6 |
| 3,400,407 | 9/1968 | Aileo | 2/6 |
| 3,548,410 | 12/1970 | Parker | 2/421 X |
| 3,925,821 | 12/1975 | Lewicki | 2/425 |

*Primary Examiner*—Alfred R. Guest

*Attorney, Agent, or Firm*—D. Gordon Angus; Donald D. Mon

[57] ABSTRACT

There is disclosed a helmet useful for crew members of an aircraft from which they may be ejected at high speeds. The helmet comprises a shell which fits over the head in a conventional manner and is provided with a strap which passes beneath the chin to retain the helmet on the head. A visor housing attached to, and spaced from, the shell is positioned to cover the forward crown part of the head and has portions which extend downwardly along the sides of the face of the wearer, which merge into the planes of flat areas at the ears. By this structure the usual bulbous shape at the ears commonly found in helmets is avoided and the side-to-side dimension is reduced.

There are formed at the upper part of the visor housing a number of discontinuous louvers forming ridges through forward facing walls of which there are apertures. During an ejection, air scooped into the region between the visor housing and the shell exits through these louver openings. A openable closure at the rear of the visor housing closes this space between the visor housing and the shell at the rear so that the air scooped within the visor housing will not emerge from the rear. The effect of the ridges and the apertures is to disrupt the smooth air flow over the top of the helmet which would otherwise occur and which would cause undesirable lift.

15 Claims, 17 Drawing Figures

4A
51
3
50
39
10
40
39
40
21
43
42
19
3
20
17
20
4A
21
18
24a
41
11
23
44
44
110
111
27
25
29
30
26
28
30a
31
36

40
6
50
40
4
51
18
6
94a
47
41
46
47a
11a
11
10
13
12
4

132
39
37
131a
130
38
39
131a
132
130

16
11a
11
13
32
24
24a
29
31
12
29
30
25
27
15
24a
34
24b
30
14

58
59
60
62a
51
61
64
62b
70
54
76
70c
74
71
53
70e
67
66
78
76
73
72
79
71a
70a
52a
75
52b
52c
52
57
83
56
56a

HELMET CHARACTERIZED BY NEGATIVE LIFT

This invention relates to protective helmets and more particularly to helmets worn during ejection from aircraft during flight, and the like.

Helmets are commonly worn on the heads of occupants of aircraft, especially military aircraft, for protection against injury to the person. Such helmets are commonly retained on the head by a retention strap system to prevent disengagement from the head while in use both in the aircraft and during ejections. A helmet is commonly provided with a transparent visor for positioning in front of the eyes of the wearer, and with a face mask which can supply oxygen to the person, and with an earphone arrangement for communication purposes.

When a person is ejected from an aircraft his helmet is subjected to high stresses which have resulted in injury to the person and in a substantial rate of loss of helmets during the ejection period. Recent statistics have indicated an average helmet loss rate of about 16% of persons ejected. Hence about 16% of persons ejected have had to go through their ejection mode without the protection of a helmet.

It has been determined that the mechanics of the helmet loss during ejection are a lifting action relative to the head, followed by a forward rotation on the head resulting in failure of the helmet strap to retain the helmet on the head. It has been calculated that the average helmet heretofore used is subject to a lifting force of about 450 pounds at an airspeed of 600 knots. This lift is due to the fact that the helmet with its visor housing basically acts as an air foil. It is known that a smooth flow of air over the surface of an air foil generates lift. It is also known that such lift can be removed or minimized by abruptly detaching the smooth air flow over the surface of the visor housing which is acting as an air foil, thereby producing a stall effect at the air foil.

Visors for such helmets have heretofore been manually movable between a downward position where the visor covers the eyes of the wearer and a retracted position where the visor is removed from in front of the eyes of the wearer. It is desirable that the visor be equipped with a visor locking device so that it locks in desired positions of retraction or extension.

Standard helmets heretofore in use have been undesirably heavy in having a weight of three to four pounds. At high accelerations which may be in the order of eight G's such helmets have produced relatively high forces resulting in fatigue of neck muscles and also contributing to catastrophic results to the spinal column during egress.

Helmets heretofore in use have commonly been provided with bulbous sides of the helmet shell to provide accommodation for ear cups. These provide undesirable obstacles to the air crew member and constitute a limiting factor in his efforts to rotate the head sideways with the purpose of eventually looking back.

An object of the present invention is to provide a helmet characterized by relatively low lifting force during egress from a moving aircraft.

Another object is to provide improved means for moving a helmet visor between forward and retracted positions and for locking the visor in a desired position.

Another object is to provide a relatively lightweight helmet with a relatively small side-to-side dimension and contoured to minimize air resistance.

A related object is to provide such a helmet with a minimum of obstructive features.

A further object is to provide a simple means for adjusting a face mask to a helmet.

Another object is to avoid any protrusions on the helmet, which if present could cause entanglement of the opened parachute shroud lines, which have caused serious neck injuries, at times fatal.

The invention is carried out by provision of a shell to fit over the head of the wearer, having flat areas at the ears, and downwardly depending areas at the sides of the face in front of the ears, inclined toward the flat areas. The visor is arranged to retract within a visor housing placed over the forward crown part of the shell and having sideburns which come down over the side face areas to merge into the same planes with the flat areas of the shell.

According to a preferred feature, the visor housing is provided with ridges protruding upwardly from the crown portion which causes a turbulence of air which serves to detach the boundary layer normally flowing over the helmet.

An optional feature of the visor housing resides in the positioning of openings through it through which air from inside the visor housing flows outwardly to further aid in detaching the boundary layer flowing over the visor housing.

When such openings are provided through the visor housing, a preferred feature resides in positioning the openings through ridges protruding upwardly from the crown portion, so that these ridges and openings cooperate to augment the counter-lifting effect by directing the disrupting air flow as much as possible perpendicular to the boundary layer flow. Preferably the openings are formed in forward rising surfaces of the ridges, but they may, if desired, be placed in rear surfaces.

Another desirable feature resides in the provision of an openable closure, closing space between the helmet shell and the rear part of the visor housing.

A further feature resides in the provision of adjustable bayonet receivers to receive the bayonets of a face mask, which are mounted in such a manner that there are no protruding features. By reason of the foregoing structure and features the weight and stress on the head of the wearer is substantially reduced as compared with prior known helments. Furthermore, the physical dimensions of the helmet, being less than prior known conventional helmets, interpose less obstruction to mobility within the cabin of an aircraft and reduce the likelihood of entanglement of shrouds of a parachute at times of egress. Moreover, the detachment of the boundary layer of air over the visor housing during egress results in reduction of lift and loss of the helmet from the head.

The foregoing and other features of the invention will be better understood from the following detailed description and the accompanying drawings of which:

Figure 1:
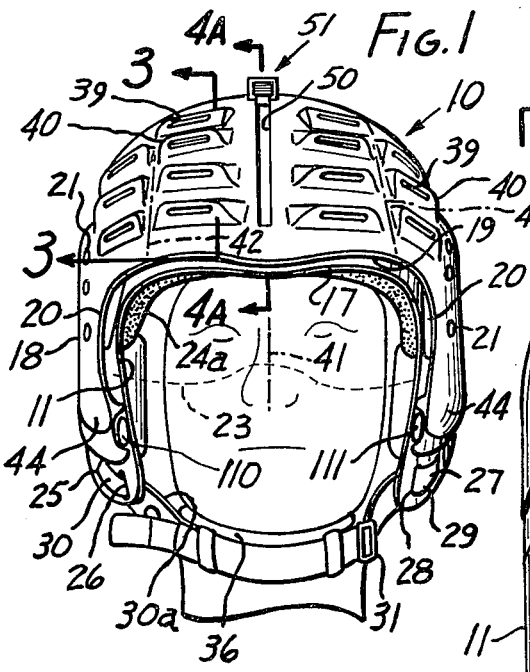
FIG. 1 is a front view of a helmet according to this invention.
Figure 3A:
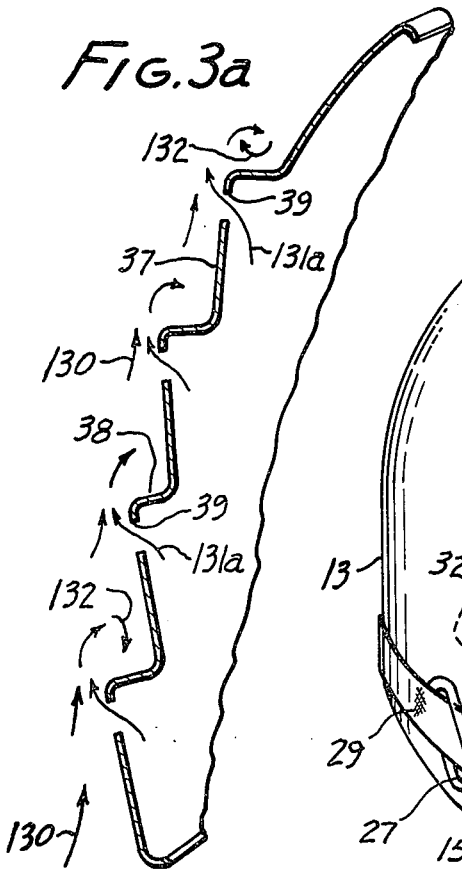
Figure 3B:
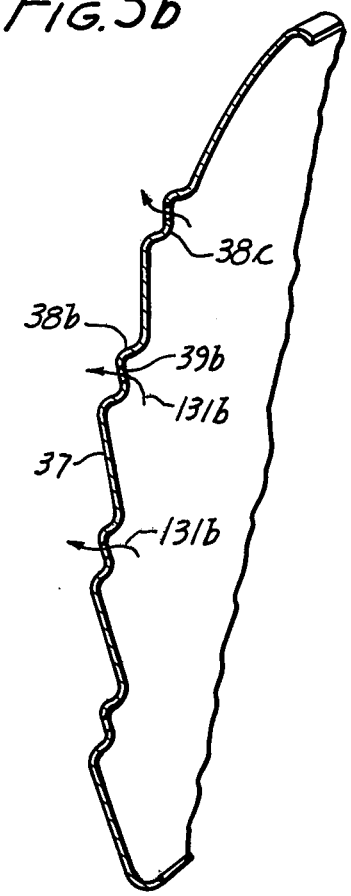

FIG. 3*a* is a cross-section view showing a detail of the louvered visor housing of the helmet taken at line 3—3 of FIG. 1;

FIG. 3*b* is a cross-section view showing a construction which differs from that of FIG. 3*a* in the positions of the louvers of the visor housing, this construction being usable alternatively to that of FIG. 3*a;*

Figure 3C:
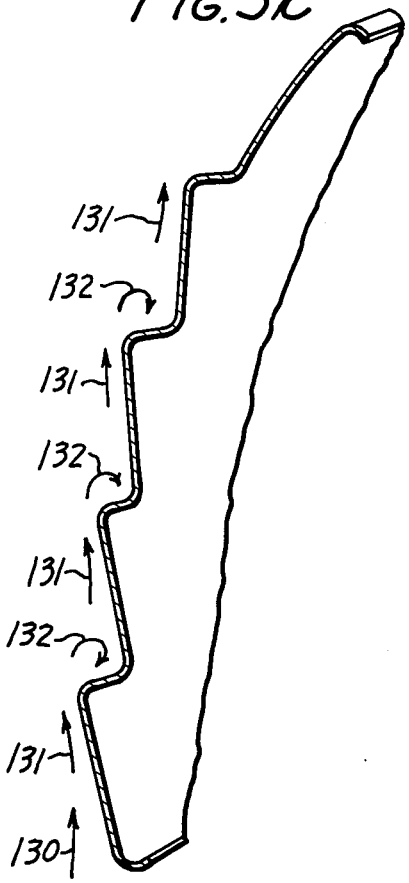

FIG. 3*c* is a cross-section view showing a construction which differs from those of FIGS. 3*a* and 3*b* in having no louvers opening in the visor housing, this construction being usable alternatively to those of FIGS. 3*a* and 3*b;*

Figure 2:
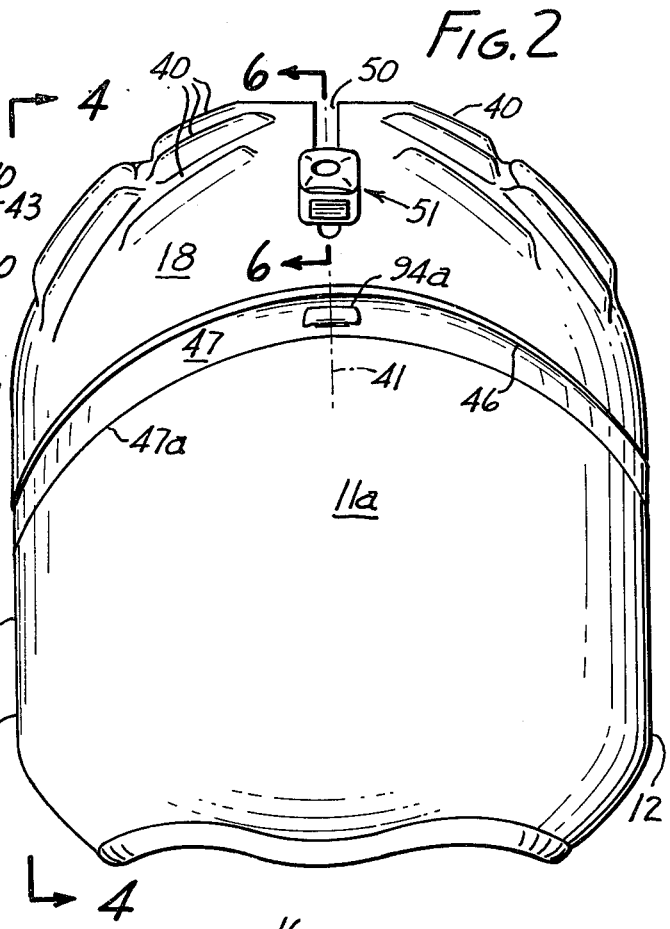
FIG. 2 is a top view, looking from the rear, of the helmet of FIG. 1 drawn on a larger scale than in FIG. 1.
Figure 5:
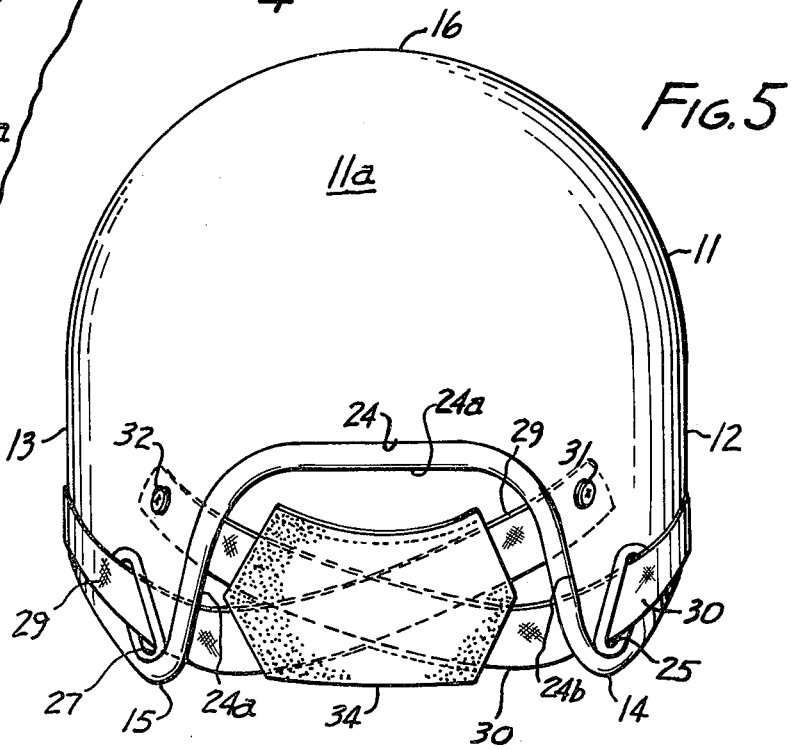
Figure 15:
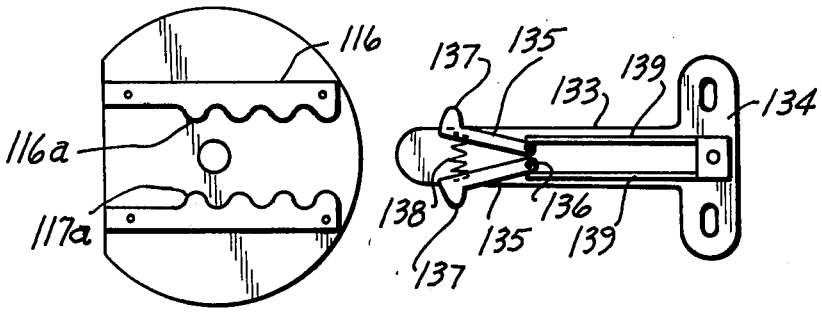
Figure 4:
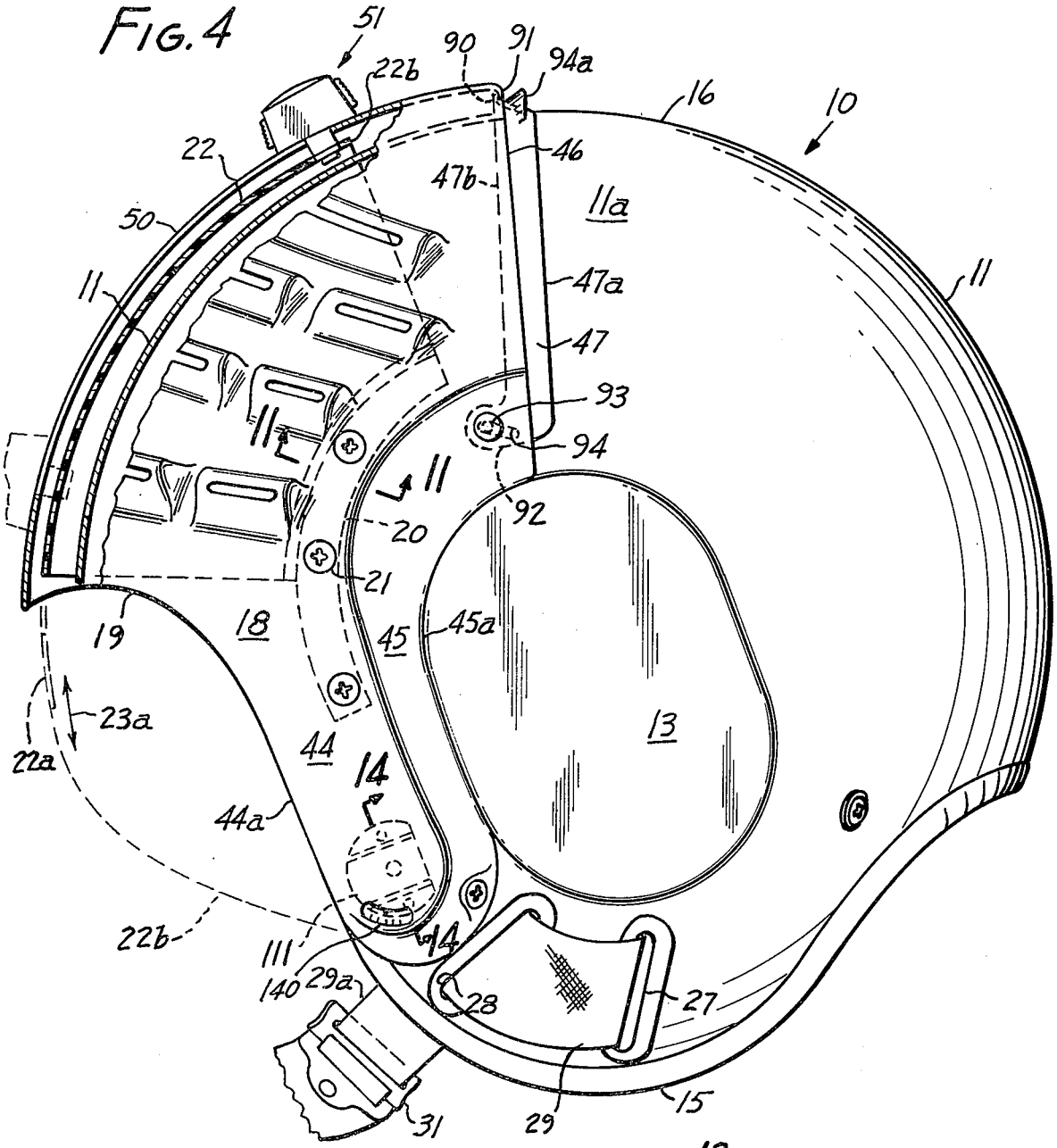
Figure 13:
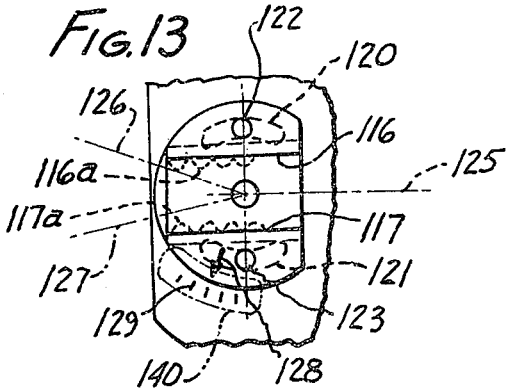
Figure 14:
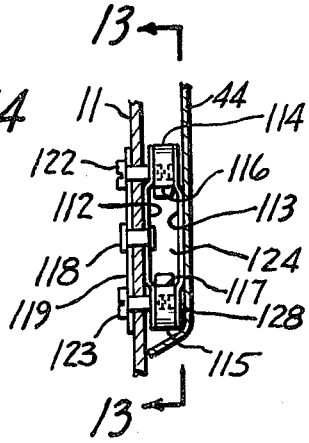
Figure 6:
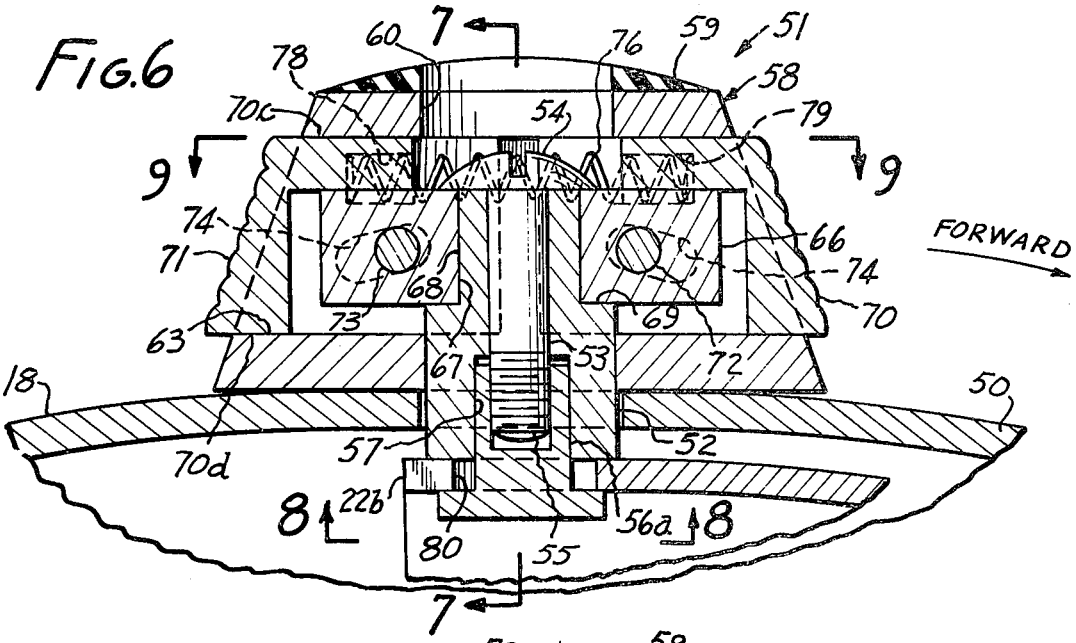
Figure 7:
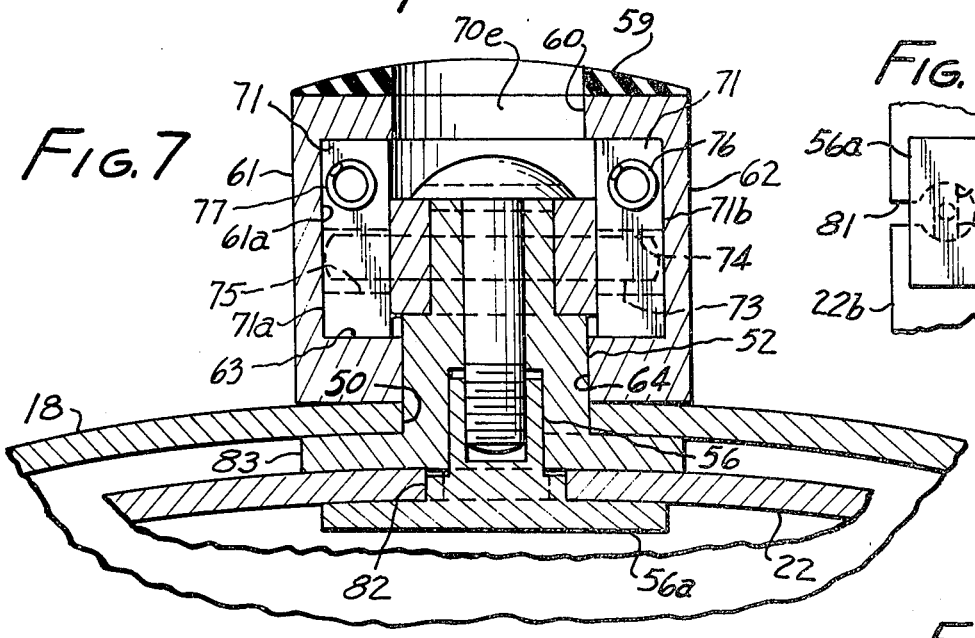
Figure 8:
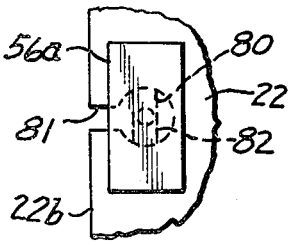
Figure 12:
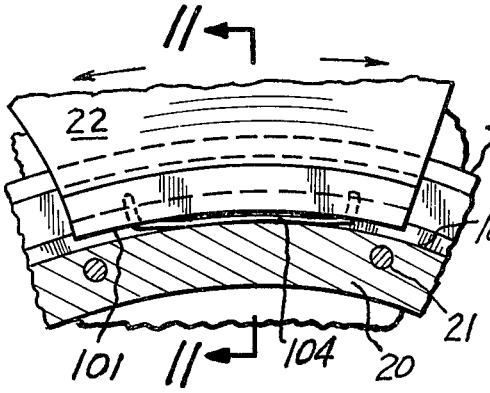
Figure 11:
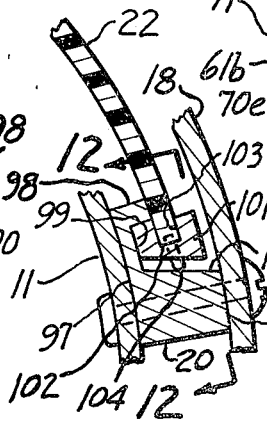
Figure 9:
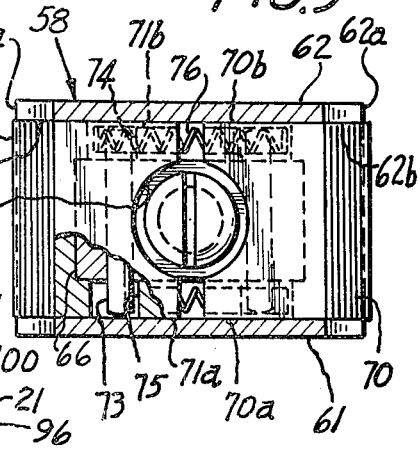
Figure 10:
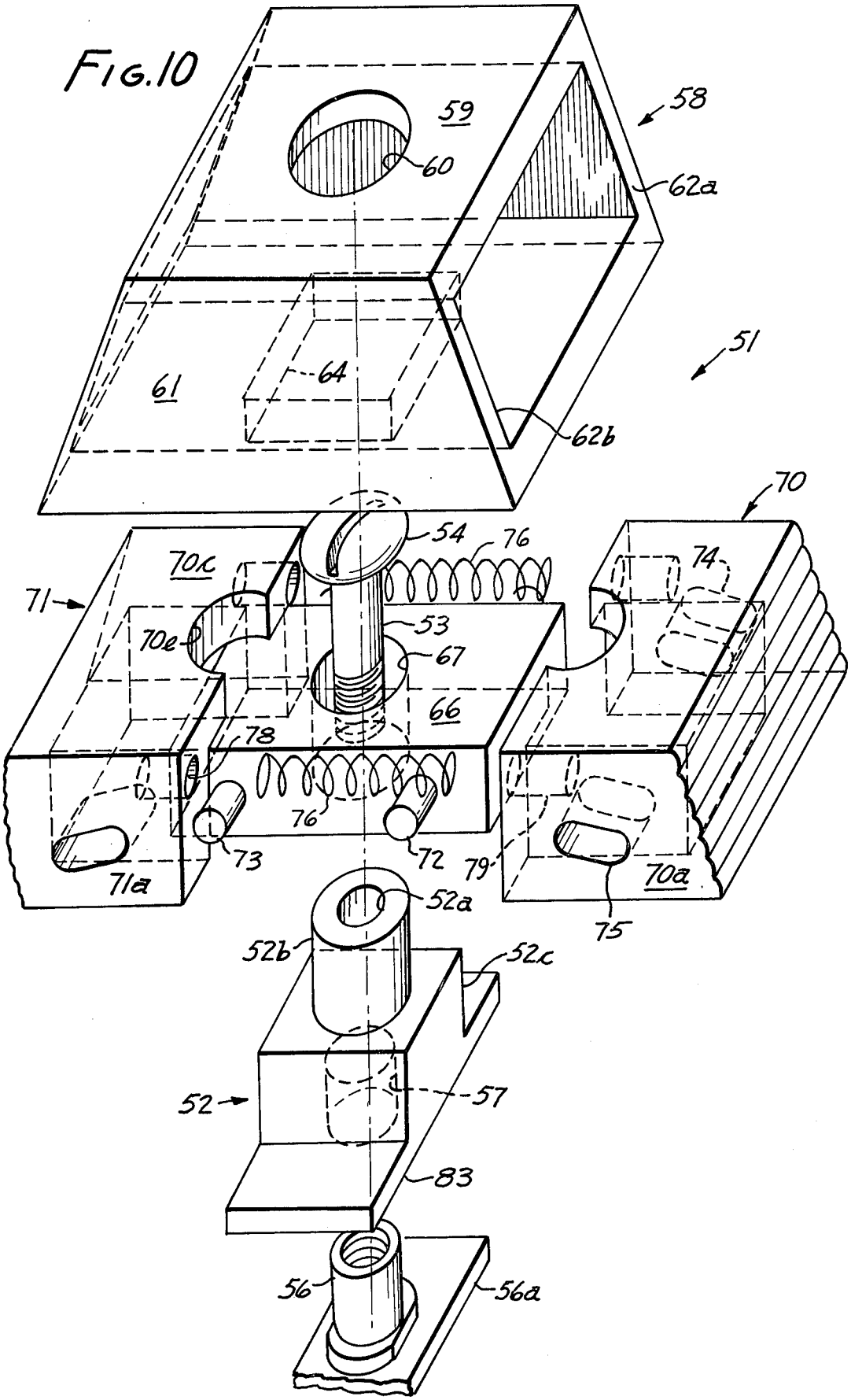

FIG. 4 is a side view of the helmet of FIGS. 1 and 2, looking from line 4—4 of FIG. 2;

FIG. 5 is a rear view of the helmet viewed from a position lower than that from which FIG. 2 is viewed;

FIG. 6 is a view partially in cross section, showing a visor lock of the helmet, looking from line 6—6 of FIG. 2;

FIG. 7 is a view partially in cross section, looking from line 7—7 of FIG. 6;

FIG. 8 is a view of a detail looking from line 8—8 of FIG. 6;

FIG. 9 is a view partially in cross section, showing a detail looking from line 9—9 of FIG. 6;

FIG. 10 is an exploded view of elements embodied in the visor lock of FIGS. 6 through 9;

FIG. 11 is a view partially in cross section, showing a detail of a visor attachment and track, looking from line 11—11 of FIG. 4, an also from line 11—11 of FIG. 12;

FIG. 12 is a cross-section view showing a detail looking from line 12—12 of FIG. 11;

FIG. 13 is a face view showing a bayonet receiver for a face mask, looking from line 13—13 of FIG. 14;

FIG. 14 is a cross-section view of the bayonet receiver mounted on the helmet shell, taken at line 14—14 of FIG. 4; and FIG. 15 illustrates the relationship of the bayonet receiver and a bayonet adapted to enter it.

The drawings show a helmet 10 comprising a shell 11 having a dome portion 11*a* which when worn covers the top and back of the wearer's head. The shell is brought down at the sides over the ears of the wearer, the right ear portion being at area 12 and the left ear portion being correspondingly located at area 13. For this purpose the right side below the ear has a relatively low peripheral contour 14 and the left side below the ear has a correspondingly low peripheral contour 15 relative to the crown area 16. The front brow line 17 is shown in FIG. 1 and when the helmet is worn the eyes of the wearer will be below the brow line. For the purpose of providing a visor housing and also for added protection to the wearer the helmet is provided with a contoured visor housing element or shield 18 covering the forward crown part of the shell 11 and having a brow line 19 near the brow line 17 of the shell. The shield 18 is spaced somewhat outward of the shell by spacing means 20 and both the spacing means and the shell are fastened to the shell by screws 21 at both sides of the helmet. The spacing means are constructed and arranged to provide visor tracks as is more fully described hereafter.

The visor housing is provided with downwardly extending extensions or "sideburns" 44 at either side of the face of the wearer as best seen in FIG. 1 at the left side of the helmet. These are contoured or slanted inwardly toward the face at the forward edges 44*a*. To the rear of each slanted portion 44 there is a flat area 45 best seen in FIG. 4 which merges with and is substantially co-planar with the flat oval shaped area 13 of the shell.

The helmet is provided with a transparent visor 22, best seen in FIG. 4, located between the foreward crown part of the shell 11 and the shield or housing element 18, and having a curvature substantially corresponding with that of the shell. When fully retracted between the shell and shield, the visor extends across the crown from side to side, and is positioned entirely between the shell and the housing. It is arranged to slide so that its forward edge 23 can be brought down from the housing to a position below the eyes as shown in phantom in FIG. 1. In FIG. 4 the lower part 22*a* of the visor is shown at a position somewhat emerged from the housing. The arrow 23*a* indicates its path of movement in sliding. The dotted line 22*b* (FIG. 4) indicates the path of the visor in moving to its lowermost position shown in phantom in FIG. 1, where it serves as a shield for the eyes of the wearer. Means for sliding the visor is described hereinafter. The periphery at the lower rear part of the helmet at the area between the ears of the wearer is contoured upwardly at 24, as best seen in FIG. 5, to leave exposed the nape of the neck of the wearer.

The inside of the shell 11 is preferably lined with cushion material 24*a* in a manner common to the art, as can be seen in FIGS. 1 and 4, for the purpose of added comfort and safety of the wearer. Instead of earphones within each side of the helmet such as helmets customerily have, the present helmet is provided with sound-insulated earcups of an elastomeric type, inside the respective areas 12 and 13 to fit over and seal around the ears of the wearer. Acoustic tubing from a transducer at the nape area to each of the earcups will provide communication to the earcups.

At each side of the helmet shell below the ear areas 12 and 13 there is provided a pair of spaced strap guide slots for passage of straps, these comprising a rearward guide slot 25 and a forward guide slot 26 at the right side, and a rearward guide slot 27 and a forward guide slot 28 at the left side. If desired, an intermediate guide slot may be provided between the forward and rearward guide slots. A pair of strap members 29 and 30 is provided for securing the helmet to the head of the wearer. One end of the strap 29 is fastened to the inside of the helmet shell at the right side by suitable fastener means 31. This strap 29 is carried across the open space between the rear peripheral shell edges 24*a* and 24*b* and through rear guide slot 27 to the exterior of the shell and back through front guide slot 28 to the interior of the shell where this front end of the strap is fastened to a buckle 31. The other strap member 30 is similarly fastened by fastener means 32 at a position at the left side of the shell corresponding to the position of fastener means 31. This strap member 30 is carried across the space between the rear peripheral edges 24*a* and 24*b* to the right side of the shell where it passes through rear guide slot 25 to the exterior of the shell and then back through front guide slot 26 to the interior of the shell. If a third slot is utilized the strap will face on the outside of the helmet. The free end 30*a* of strap member 30 is longer than the free end of strap member 29 so that strap end 30*a* can be passed under the chin of the wearer and looped through the buckle 31. A fastening means is provided for holding strap member 30 secure to strap member 29 after passing it through buckle 31. This holding means may comprise strips of material fastened to one side of strap end 30*a* and spaced somewhat from each other. This space between the material strips is positioned to be located at the buckle 31 when the strap is tightened beneath the chin of the wearer. Then by folding the strap end 20*a* back on itself the said strips of material may be made to overlie each other. The material or materials of these strips are such that they will cling to each other. The said strips of material are not seen in FIG. 1 or any of the other figures, as they are covered by the strap end 30*a* in FIG. 1. The arrangement of the straps in relation to the helmet and the wearer is similar to that shown for the straps in co-pending application Ser. No. 612,905, filed Sept. 12, 1975 now abandoned. It will be understood that some other form of fastening means may be used if desired.

At the nape area the strap members 29 and 30 cross each other as seen in FIG. 5 and at this area a nape pad 34 of a suitable soft material is attached to both straps in a suitable manner. At the position where strap end 30*a* passes beneath the wearer's chin there is provided a pad 36 which may be made to adhere to this strap end by a suitable adhesive or by other desired means of attachment. When the helmet is put on the head of the wearer the pad 34 is applied at the nape of the wearer's neck. The chin strap end 30*a* is carried under the chin so that the pad 36 is in contact with the under side of the chin and this strap is then looped through the buckle 31 and fastened by the fasteners as described above. In pulling the strap members 29 and 30 together with mild tightness in this manner, the nape pad 34 is in mild pressure contact with the nape of the wearer and the chin pad 36 is likewise in mild contact with the underside of the wearer's chin. Thus, the crossed strap portions at the nape acts as a nape strap and the portion under the chin acts as a chin strap, forming a closed loop of minimum circumference. This secures the helmet to the head and prevents it from coming off in the event of an ejection. It is recognized that when the strap members are drawn together to the proper degree of tightness at the chin, they are also at the proper degree of tightness at the nape, owing to the slidability of the strap members at the strap guides. The general arrangement of the straps in their guides is similar to that shown in said prior application Ser. No. 612,905.

The helmet illustrated in FIGS. 1 through 14 hereof is provided with features in addition to those shown in application Ser. No. 612,905, as will be described presently.

Referring to FIGS. 1 and 3*a*, the upper and forehead part of the visor housing 18 is provided with a number of raised louvers which extend laterally relative to the head of the wearer and have a curvature causing them to act as "spoilers" relative to air passing by the helmet during an ejection. The forward wall 37 of each row of these louvers slants rearwardly and upwardly from the main contour of shield 18 as best seen in FIGS. 3 and 4. The rear wall 38 of each louver is re-entrant back to the general level of the contoured surface so that each pair of adjacent walls 37 and 38 forms a ridge 40. Each forward louver wall 37 is provided with a laterally extending opening 39 for egress of air entering the region between the helmet shell 11 and the visor housing 18. The louver ridges are discontinuous in their lateral extent. Thus, the region along the fore and aft center line 41 (FIGS. 1 and 2) is devoid of louver structure. Also there is a discontinuity of louver structure at the regions marked by broken lines 42 and 43 in FIG. 1.

An optional alternative to the louver construction shown in FIGS. 1 and 3*a* is shown in FIG. 3*b* wherein the rear walls 38 of FIG. 3*a* are replaced by rear walls 38*b* which are provided with a jog 38*c*. Also the openings 39 appearing in the forward walls 37 of FIG. 3*a* are eliminated in FIG. 3*b* where they are replaced by openings 39*b*. It is seen that the openings 38*d* face in substantially the same direction as the openings 39 of FIG. 3*a*.

FIG. 3*c* illustrates still another modification from the structure shown in FIGS. 1 and 3*a*. In FIG. 3*c* the ridges are the same as those illustrated in FIGS. 1 and 2 and 3*a*, except that no louver openings such as openings 39 and 39*b* are present.

The space existing between the rounded rear edge 46 of the visor housing and the dome of shell 11 is normally closed by a closure 47, seen in FIGS. 2 and 4. It comprises a curved ring extending over the crown of the shell and down each side to a position almost at the lower side periphery 45*a* of the visor housing. The rear edge 47*a* lies flat against the shell with which its curvature conforms. From the rear edge 47*a* the closure flares outwardly to engage the rear rim 46 of the visor housing along the forward edge 47*b* of the closure. For the purpose of engaging the forward edge 47*b* with the rear edge of the visor housing, the edge 47*b* is provided with an outstanding lip 90 and the rear edge 46 of the visor housing is provided with a depending lip 91 such that lip 90 can be retained in front of lip 91 as seen in FIG. 4. The lower end of each side of the closure 47 is provided with an offset 92 which extends forwardly within the visor housing. The offset at each side is provided with an outwardly extending pin 93 which protrudes through a slot 94 through the visor housing. The slot slants downwardly and rearwardly so that the closure may be disengaged from its position at the visor housing shown in FIG. 4. For this purpose a tab 94*a* is attached to the upper part of the closure. The disengagement of the closure from its position shown in FIG. 4 may be accomplished by manually pushing downwardly on the tab so that the pins 93 slide downwardly and rearwardly through their slots thereby allowing the lip 90 of the closure to move inwardly and thus clear the lip 91 of the visor housing to open the closure which will pivot at the pins 93. The resilience of the closure material facilitates this operation. A reason for this provision of an openable closure is to facilitate the removal or changing of the visor as may be desired, by the aircrew member, without the use of tools.

For the purpose of actuating and locking the visor, the visor housing is provided with a slot 50 along the center line 41. This slot commences at a position near the brow line of the housing, and extends rearwardly to a position near the upper rear end of the housing, the length of this slot being equal to the distance of movement of the visor in moving from a completely open position to a completely closed position where it is covering the face and eyes of the wearer by the maximum amount.

A visor lock 51 extends through this slot and attaches to the rear end of visor 22 such that the visor may be operated manually to slide the visor and to lock it into any desired position, which will ordinarily be either the position of maximum retraction or of maximum advance down in front of the eyes. Details of the visor lock are best seen in FIGS. 6, 7, 8, 9 and 10. It comprises a body 52 having through it an opening 52*a* through which there extends a screw 53 having a head 54 and threads 55 which thread into a nut having a cylindrical shank 56 dimensioned to fit into a cylindrical recess 57 of the body 52, which is an enlargement of, and coaxial with, hole 52*a*. The upper portion 52*b* of body 52 is cylindrical, below which there is a section 52*c* of square cross section. The lower end of the body enlarges laterally forming a wing 83. The lower end of the nut shank 56 is provided with a rectangular flange portion 56*a*. The visor lock is provided with a housing 58 which is rectangular as seen from above. It contains a top wall 59, preferably covered by a cap 59*a* of a soft or resilient material to avoid damaging knocks against an aircraft cabin wall or the like, through which there is a circular hole 60, and a pair of opposite lateral sides 61 and 62, and a bottom wall 63 having a rectangular hole 64 axially aligned with hole 60. The fore and aft walls 62*a* and 61*a* are each provided with a rectangular opening 62*b* and 61*b*, respectively. Within the lock housing there is provided a rectangular block 66 having through it a circular hole 67 which fits over the outer circumference 52*b* of the portion of bushing 52 immediately beneath the screw head 54. The inner portion of block 66 rests on the shoulder 69 of body section 52*c* and is held between this shoulder and the screw head.

The visor lock is provided with a pair of actuators 70 and 71, similar to each other, located on opposite sides of body 52 in the fore and aft direction of movement of the visor lock through the slot 50. These actuators are within the lateral walls 61 and 62 of the visor lock housing but protrude from the respective rectangular openings 62*b* and 61*b* of the lock housing in the fore and aft direction, as seen in FIGS. 6 and 9. Actuator 71 has side walls 71*a* and 71*b* which slidably fit within walls 61 and 62 of housing 58. Similarly actuator 70 has side walls 70*a* and 70*b* which slidably fit within walls 61 and 62. The upper wall 70*c* and lower wall 70*d* of actuator 71 slidably fit into top and bottom walls 59 and 63 respectively. The upper and lower walls of actuator 70 similarly fit slidably within the upper and lower walls of the lock housing. The side walls of the actuators also have a sliding fit over the side walls of block 66. The upper walls of the actuators are provided with arcuate surfaces 70*e* for clearance from the screw head 54. Each of a pair of pins 72, 73 is fixed to, and extends laterally through, block 66 at opposite sides of body 52, in the fore and aft direction, and protrudes laterally beyond opposite sides of the block. These laterally protruding ends of pin 73 extend into respective slots 74 and 75 through the opposite side walls 71*a* and 71*b* of actuator 71. Actuator 70 has a similar pair of slots 74 and 75 similarly located which receive the ends of pin 72. Each of these slots is elongated with its longer axis slanted upwardly from the horizontal toward the screw 53. The diameters of the pins relative to the widths of the slots are such that the pins make sliding contact within the slot walls. Thus the actuators 70 and 71 are slidable through the lock housing 58 in the fore and aft direction toward and away from each other. Compression springs 76 and 77 are provided for urging the actuators 70 and 71 to slide away from each other. For this purpose each actuator is provided with a pair of bores 78 and 79 into which the ends of the compression springs are fitted.

For attachment of the visor lock to the visor, the visor is provided with a circular hole 80 near its rear edge 22*b* as best seen in FIG. 8. This hole opens to the rear edge 22*b* of the visor through a slot 81 which is relatively narrow compared to the diameter of the hole 80. The portion of the nut just above the lower flange 56*a* is provided with a wing 82 of a length permitting its extremities to fit closely within the circumference of circular hole 80. Thus by turning the nut 90° relative to the position indicated in FIG. 8 the wing may pass through slot 81 into hole 80 and then turn 90° to the position shown in FIG. 8 where the nut fastens to the visor by turning screw 53. The body 52 is provided with a wing 83 extending laterally in both directions at a position on the upper side of the visor so that when the nut 53 is tightened the visor is clamped between wings 56*a* and 83. The dimension of square section 52*c* is such that it will slide through slot 50 but will not rotate within the slot.

By reason of the compressive force of springs 76 and 77 urging the actuators 70 and 71 to slide apart from each other the slots of the two actuators move apart to the same extent. This produces a lifting action on the pins which correspondingly exerts a lifting force on block 66, screw 53, nut 56 and body 52 with its flange 83, relative to the bottom of the lock housing. Hence the part of the visor housing 18 on both sides of the slot 50 are squeezed between the flange 83 and the bottom of the lock housing so that the visor will remain in a locked condition. When it is desired to move the visor, the actuators 70 and 71 are manually squeezed together, for example between the thumb and forefinger, against the force of the springs so that the action of the actuator slots against the pins 72 and 73 causes the body 52 to tend to move downward to release the pressure of flange 83 from the under side of the visor housing so that the visor lock can easily be moved forwardly or rearwardly through the slot 50 to change the position of the visor.

It is seen that the visor lock is assembled by putting its component parts in their places and torquing the screw 53 to pull the nut 56 up into hole 57 of the body 52. This is done before inserting the pins 72 and 73 in their places. Then the pins are put into the assembly by inserting them through the respective slots of the actuator and through the holes of block 66. The fit of the pins through block 66 is a force fit which effectively fixes them to the block.

The visor slides on a pair of tracks which are formed in the spacing element 20 at each side of the helmet between the shell and the visor housing. This spacer-track 20 is indicated in dotted lines at its position beneath the visor housing in FIG. 4, at the left side of the helmet. FIGS. 11 and 12 show details of the track. The detail of FIG. 11 is taken from line 11—11 of FIG. 4 and it also appears at line 11—11 of FIG. 12.

It is seen that the track-spacer member 20 has a surface 96 flush with the inside surface of the visor housing 18 and an opposite surface flush with the outer surface of the helmet shell 11. A lip 98 extends outwardly toward visor housing 18 for a distance, and below the lip there is formed the side surface 99 of the visor track. Surface 99 meets the bottom surface 100 of the track which extends between surface 99 and the surface 96. A visor strip 101 is provided to receive the bottom side edge 102 of the visor, which fits into a slot 103 formed along the length of strip 101. The visor is attached to this strip as by adhesive. The visor 101 has a curvature conforming with that of the track which is curved to conform with the direction of movement of the visor. When the visor is pulled down over the eyes from a retracted position, the track 101 slides with the visor through the elongated curved passage formed by elements 98, 99 and 100 of member 20. To facilitate the sliding of the visor strip 101 there may be provided a wirelike member 104 bent at each end so as to protrude into the bottom side of the visor strip causing it to ride easily on track surface 100.

It is a common practice to use with the helmet a face mask for supplying oxygen. Such a face mask is commonly attached to the helmet by means of bayonets at the sides which enter into bayonet receivers at the respective sides of the helmet. The forward ends of such bayonet receivers 110 and 111 are seen in FIG. 1 located between each depending sideburn of the visor housing and the exterior of the helmet shell. The side of bayonet receiver 111 is shown in FIG. 13 and is also shown in broken lines in FIG. 4 which show its position behind the lower part of sideburn 44. FIG. 14 shows a front view of this bayonet receiver looking from line 14—14 of FIG. 4. FIG. 15 shows the relation of one of the bayonet receivers to one of the bayonets. Each bayonet receiver comprises a pair of discs 112 and 113 held apart from each other by spacers 114 and 115 opposite each other at the periphery where the discs are shaped to have a lesser spacing from each other than at the center. The spacers have juxtaposed parallel surfaces 116 and 117 provided with juxtaposed teeth 116*a* and 117*a*, located at opposite sides of the center of the disc, and are attached to the discs.

The disc 112 is rotatably pivoted by a pivot pin 118 to the shell 11, this pivot pin passing also through a backing strip 119 inside the shell 11. A pair of slots 120 and 121 of equal size and shape are formed through the shell and the backing sheet 119 at opposite sides of the pivot pin 118, the center of curvature of these arcs being at the pivot pin. Screws 122 and 123 pass through these respective slots and thread into the respective spacers 114 and 115 at a position diametrically opposite each other. The arrangement is such that when the screws are threaded relatively loosely into their respective spacers the discs can be rotated on the pivot within the limits permitted by the lengths of the arcuate slots, both of which are of the same length. When the two screws are torqued, the peripheral parts of the disc are pulled toward the shell to bind the inner part of disc 112 against the shell so that the discs will not turn relative to the slots after the screws are sufficiently torqued. It is seen that when the screws are tightened while centrally located within their slots as shown in FIG. 13, the central axis of the channel 124 between the discs can be made substantially horizontal as indicated by line 125 (FIG. 13). When the discs are rotated to the maximum extent in one direction the axis of the channel turns to the position indicated by line 126, and when turned the maximum amount in the opposite direction the axis turns to the position indicated by line 127.

A common form of bayonet for a face mask comprises a prong member 133 protruding from a base portion 134 attached to the mask (not shown). A pair of dogs 135 are pivoted at 136 to the prong, the forward end of each dog being provided with a tooth 137. A spring 138 tends to hold the teeth apart from each other. When the prong is inserted into the bayonet receiver, the curvature at the forward edges of the teeth 137 causes them to cam on the respective teeth 116*a* and 116*b* of the receiver, allowing the teeth 137 to enter the base portions of teeth 116*a* and 117*a* at a desired position along the extent of teeth 116*a* and 117*a*. When it is desired to withdraw the bayonet from the receiver, the teeth 137 are forced toward each other against the force of spring 138 by a mechanism which moves levers 139 along dogs 135 to do this. The mask and bayonets are known devices and no part of the present invention.

According to a desirable but optional feature, for the purpose of indicating the position of the axis of this channel, an arrow 128 is marked on the outer surface of the outer disc 113 and lines 129 representing a scale of degrees of the arc through which the disc may turn are marked on the outer surface of the shell just outside the periphery of the discs. Thus, the arrow 128 is shown in FIG. 13 pointing to the central line of the scale to indicate that the channel 124 extends horizontally on axis 125. If the disc be turned to a position in which the channel axis is other than horizontal the angularity will be indicated by the arrow on the scale. Where this type of indicator and scale are used it will be desirable to provide a window of transparent material through, and flush with, the sideburns at the locations of the arrow and scale, within the area enclosed by the broken line enclosure 140 in FIG. 4.

The advantage of these adjustable bayonet receivers with their indicators of angularity resides in the fact that the best angle of the bayonet receivers for proper placement of the mask varies from person to person. Accordingly, when a helmet is assigned to a particular person, he may make the correct angular adjustment by loosening screws 122, 123 and then inserting the bayonets of his face mask into the bayonet receivers of his helmet while wearing the helmet in its proper position. The face mask will then be properly adjusted which may be done since the screws 122 and 123 are now loose, thus allowing the discs to be turned to the proper position. When this proper position is found, the helmet will be removed from the wearer's head while maintaining the face mask in this same position, and the screws 122 and 123 will then be tightened to maintain this position. The advantage of the window 140 is that the wearer may read the angular position through the window. It will be well for the wearer to make a note of the correct angular position, because subsequent use of the helmet and mask by some other person would likely involve a different adjustment of the face mask. Then when the first-mentioned wearer is about to wear the helmet again, he may readily adjust the angularity to the original angular reading by loosening the screws 122 and 123 and then tightening them again after the adjustment is made.

In the interest of lightness of weight, the helmet shell should be made of a relatively lightweight material having low weight-high strength ratio properties, such as a reinforced epoxy resin. The visor housing should likewise be of a lightweight-high strength material. In view of the relatively small side-to-side dimension of the helmet, it is preferable to eliminate earphones from the sides and instead to supply ear cups of an elastomeric material of shallow lateral dimension to which acoustical tubes are brought from a transducer located within the rear of the shell at the nape of the neck. The compliance of the elastomeric material enhances the fit and comfort for the wearer.

From the foregoing description and illustration of the features of the helmet it is seen that there is provided a helmet of relatively light weight, relatively low profile and relatively small bulk which is comfortable to wear and is free from obstacles to movement of the person.

The visor housing is unique in the arrangement of its ridges and also in its louver apertures when such apertures are present, as is preferred. The action of the non-apertured ridges can be seen by reference to FIG. 3*c*. In the absence of these ridges, air indicated by arrows 130 rushing over the upper surface of the visor housing would cause the visor housing to act as an air foil producing undesirable lift in a well-known manner. The presence of the ridges causes some of this surface air to curl outward as indicated by arrows 131. The generation of the curl represented by arrows 131 meeting the air flow represented by arrows 130 produces a turbulence represented by arrows 132 at the rearward surfaces of the ridges. This turbulence indicated by arrows 132 above the visor housing disrupts the skin effect at the top of the visor housing which would otherwise occur, and the disruption of the skin effect reduces the undesirable lift on the helmet.

The beneficial effect of the louver apertures at the ridges can be seen by reference to FIGS. 3*a* and 3*b*. Referring to FIG. 3*a* there is created, in addition to the turbulence due to the ridges themselves as illustrated in FIG. 3*c*, an additional turbulence effect due to the fact that air entering the space inside the visor housing at the front, between the visor housing and the shell, emerges from the visor housing with a forward component of direction through openings 39 as indicated by arrows 131*a*. This augments the effect of the air generated by the ridges represented by arrows 131 in FIG. 3*c*, which is also present in FIG. 3*a*. Hence the turbulence effect is augmented with consequent further reduction of the undesirable lift on the helmet. It has been found that the location of the openings 39 in the forward facing surfaces of the louver ridges is of substantial importance in reduction of the lift.

Although it is preferred to place the louver openings in the forward facing walls of the ridges, a considerable degree of beneficial effect is also obtainable when the louver openings are placed in the rearward facing walls of the ridges as shown at 39*b* in FIG. 3*b*. In this case the flows of air are similar to those described in connection with FIG. 3*a*, and the flow represented by arrows 131*b* through the apertures is in the same direction as the flow represented as 131*a* in FIG. 3*a*. The flow represented by arrows 131*b*, commencing from behind a portion of the jogged rear ridge walls, does not immediately impinge against the main skin flow 130 which is present as in FIGS. 3*c* and 3*a*. The turbulence effect, however, is quite similar to that of FIG. 3*a*.

The unique design and arrangement of the visor lock provides means for easily and rapidly adjusting the position of the visor by a simple squeezing of the actuators toward each other, and of locking it by releasing the squeezing of the actuators. The closure member 47 at the rear edge of the visor housing provides a means for preventing the air, which has entered through the front of the visor housing during an ejection, from flowing readily out through the rear between the visor housing and the shell. It causes the air which has entered within the visor housing to flow out through the louver openings 39. The closure 47 is nevertheless openable so that when it is desired to change a visor the tab can be pushed down and outward, away from the visor housing. The visor is then moved to its rearmost position, and the knob 5 is removed by turning the screw 53 by a screwdriver applied to its head 54, thereby allowing the housing or knob 58 to be removed and allowing the nut and its shank 56 to drop downward. The visor can then be pulled out through the opened rear closure together with the nut. The nut can then be removed from the visor by turning it 90° from the position shown in FIG. 8 and withdrawing it through the slot 81. The nut can then be applied to a new visor which can be inserted beneath the visor housing through the opened rear closure together with the nut. The knob housing 58 can then be attached again by threading the screw 53 into the nut.

The sideburns of the visor housing having their portions co-planar with the areas 13 of the shell are unique and contribute to the streamlined effect of the helmet.

The adjustable bayonet receivers with their angularity indicators provide an easy means for adjusting the position of a face mask to a person.

It will be understood that the embodiments of the invention illustrated and described herein are given by way of illustration and not of limitation, and that modifications or equivalents or alternatives within the scope of the invention may suggest themselves to those skilled in the art.

We claim:

1. In a helmet adapted for use in aircraft and during ejection therefrom, said helmet being of the type having a shell covers the wearer's head, a visor housing spaced from and covering, an upper part of the shell, a visor retractable within the space between the shell and the visor housing and strap means for securing the helmet to the head of a wearer:

ridge means extending laterally and protruding upwardly at the top of the visor housing;

whereby when a wearer is ejected from an aircraft moving through the air there is created a disruption of the flow of air over the top of the helmet, resulting in reduction of the lift which would otherwise occur.

2. Equipment according to claim 1 in which said ridge means comprises a plurality of laterally extending ridges.

3. Equipment according to claim 2 in which there are discontinuities of the ridges.

4. Equipment according to claim 3 in which the ridges contain apertures positioned in forward facing walls of said ridges and a closure closes the space between the shell and the visor housing at the rear of the visor housing and a slot extends forwardly through the visor housing from an upper part of said housing toward the front of said housing; and handle means attached to the visor and protruding through the slot to a position above the visor housing where it can be manually moved along the slot to extend and retract the visor, said handle means comprising a lock for locking the handle means to the visor housing to prevent movement of the visor, and manually operable means for releasing the lock so that the visor can be moved.

5. Equipment according to claim 4 in which said closure is openable to provide access to the visor within the visor housing.

6. Equipment according to claim 5 in which said lock comprises a first member which engages the outer wall of the visor housing and a second member movable relative to said first member, which engages the inner wall of the visor housing, spring means urging said first and second members to move toward each other to grip the visor housing wall between them to produce the locking effect, and manually operable actuator means outside the visor housing to push said first and second members apart for releasing the lock and permitting sliding of the visor.

7. Equipment according to claim 6 in which the sides of the shell located outside the ears of the wearer are in the form of flat planar areas parallel to each other and the visor housing and is provided with depending portions at each side of the face and in front of the respective flat planar areas, each depending portion containing a flat area co-planar with the respective planar area of the shell.

8. Equipment according to claim 1 in which said ridge means contains apertures through which air flows outward from the visor housing during an ejection.

9. Equipment according to claim 8 in which said ridge means has a forwardly facing wall means and said apertures are positioned through said forward facing wall means.

10. Equipment according to claim 8 in which said ridge means has a rearwardly facing wall means and said apertures are positioned through said rearwardly facing wall means.

11. Equipment according to claim 8 in which said helmet is provided with a closure which closes the space between the shell and the visor housing at the rear of the visor housing, thereby preventing exiting of air through said space at the rear of the visor housing.

12. Equipment according to claim 11 in which said closure is openable to provide access to the visor within the visor housing.

13. Equipment according to claim 12 in which said closure is rendered openable by slot means and pin means at the lower sides of the helmet, said closure being openable and closeable by pivoting of said pin means through said slot means, said slot means being elongated and slanted downwardly and rearwardly.

14. Equipment according to claim 13 in which a lip is formed on the outer edge of said closure and an inwardly protruding lip is formed at the rear edge of said visor housing such that the lip of the closure engages in front of the lip of the visor housing to maintain the closure in a closed position, said lips being disengageable from each other to permit opening of the closure by downward and rearward pressure on the closure at the pin means and slot means.

15. Equipment according to claim 1 in which the sides of the shell located outside the ears of the wearer are in the form of flat planar areas parallel to each other and the visor housing is provided with depending portions at each side of the face, and in front of the respective flat planar areas, each depending portion containing a flat area co-planar with the respective planar area of the shell.

* * * * *